US005353939A

United States Patent [19]

Beeler et al.

[11] Patent Number: 5,353,939

[45] Date of Patent: Oct. 11, 1994

[54] VARIABLE PUSHER POINT OF PURCHASE DISPLAY

[75] Inventors: Mark T. Beeler; Brian H. Welker, both of Winston-Salem, N.C.

[73] Assignee: Decision Point Marketing, Inc., Winston-Salem, N.C.

[21] Appl. No.: 952,245

[22] Filed: Sep. 28, 1992

[51] Int. Cl.[5] ..... A47F 5/00

[52] U.S. Cl. ..... 211/59.3; 211/184; 312/61; 312/71

[58] Field of Search ..... 211/59.3, 59.2, 184, 211/51; 312/61, 71

[56] References Cited

U.S. PATENT DOCUMENTS

| | | | |
|---|---|---|---|
| 2,730,825 | 1/1956 | Wilds | 211/59.2 X |
| 2,954,129 | 9/1960 | Gordon | 211/49 |
| 3,110,402 | 11/1963 | Mogulescu | 211/59.3 |
| 3,308,961 | 3/1967 | Chesley | 211/59.3 |
| 3,357,597 | 12/1967 | Groff | 221/279 |
| 3,780,873 | 12/1973 | Silva | 211/49 D |
| 3,848,745 | 11/1974 | Smith | 211/49 |
| 4,269,326 | 5/1981 | Delbrouck | 221/227 |
| 4,351,439 | 9/1982 | Taylor | 211/49 D |
| 4,729,481 | 3/1988 | Hawkinson et al. | 211/59.3 |
| 4,730,741 | 3/1988 | Jackle et al. | 211/59.3 |
| 4,732,282 | 3/1988 | Lockwood | 211/59.2 |
| 4,762,236 | 8/1988 | Jackle, III et al. | 211/59.3 |
| 4,785,943 | 11/1988 | Deffner et al. | 211/59.2 |
| 4,830,201 | 5/1989 | Breslow | 211/184 |
| 4,898,282 | 2/1990 | Hawkinson | 211/49.1 |
| 4,907,707 | 3/1990 | Crum | 211/59.3 |
| 4,923,070 | 5/1990 | Jackle et al. | 211/59.2 |
| 5,012,936 | 5/1991 | Crum | 211/59.3 |
| 5,027,957 | 7/1991 | Skalski | 211/59.3 |
| 5,088,607 | 2/1992 | Risafi et al. | 211/59.3 |
| 5,131,563 | 7/1992 | Yablans | 221/92 |

*Primary Examiner*—Robert W. Gibson, Jr.
*Attorney, Agent, or Firm*—Rhodes, Coats & Bennett

[57] ABSTRACT

An apparatus for displaying packages in a retail environment includes a rack having vertical sidewalls and a bar interconnecting the sidewalls. A tray has protrusions from an underside thereof adapted to engage the bars to support the tray in a first, retracted package displaying position and a second, extended package loading position. A divider insert includes a plurality of parallel upright divider walls and is sized to releasably fit within the tray, thereby forming channels atop the tray. A plurality of product pushers are releasably connected to the tray in the channels. Packages to be displayed may be positioned in the channels for the product pusher to urge them to one end of the tray for retail purchase and the apparatus may be disassembled to arrange a different divider insert and a plurality of pushers differently in the tray.

49 Claims, 5 Drawing Sheets

VARIABLE PUSHER POINT OF PURCHASE DISPLAY

BACKGROUND OF THE INVENTION

The present invention relates to improvements in point-of-sale displays, particularly those that have aids to urge product toward the front of the shelf, known in the trade as "pusher"-type displays.

It is known to display packages such as envelopes of pantyhose in a self-feeding arrangement. This includes a rack having side walls and horizontally extending bars with a tray supported on the bar in a slanted manner. The tray is divided into channels and a box of, literally, rocks is positioned behind the product in the channels. By virtue of the slant of the channel, the box of rocks pushes the products forwardly in the channel as each forwardmost package is removed. This arrangement has been used successfully for a number of years, but it has a number of disadvantages. First, the rocks, being provided simply for the purpose of providing weight, make the entire display a very heavy device, raising shipping costs. Also, since the tray in which the product is displayed is integrally formed, the channels are of an invariable size. Thus, to display products of a different size, the entire tray and boxes of rocks must be discarded and be replaced by a different product. Furthermore, it has been found that the box of rocks may lose or absorb moisture and these can be a source of biological activity giving rise to unsightly growths, clearly undesirable in a merchandising environment.

Spring-driven pusher displays are known, such as those shown in U.S. Pat. No. 4,830,201 to Breslow and assigned to RTC Industries, Inc. That display uses a spring-urged motive member to direct product toward the front of a shelf, with the spring being mounted on a component which acts as a divider as well as a spring anchor. The apparatus of the Breslow patent can be used with merchandise of various sizes, but the side dividers must be positioned with care, something that does not invariably happen in field installations. The result may be the dividers are positioned too close together, so that the product is pinched and does not advance properly. Or, the dividers may be too far apart, so that the product is delivered sideways or, simply that valuable shelf space will be wasted.

Accordingly, there is a need in the art for a point of purchase display having pusher capability, but which can be easily and inexpensively modified to vary from one product size to another, without requiring expensive field expertise.

SUMMARY OF THE INVENTION

The present invention fulfills this need in the art by providing an apparatus for displaying goods in a retail environment including a tray having a plurality of location means across a width of the tray, and a plurality of product pushers releasably connected to the tray and positioned in the tray in reference to the location means. Thus, goods to be displayed may be positioned forwardly of the product pushers to urge them to one end of the tray for retail purchase and the apparatus may be disassembled to arrange a different plurality of product pushers differently in the tray. In one aspect the location means includes a divider insert defining channels in the tray for location of the product pushers. In another aspect the location means includes a plurality of connector portions formed in the tray, with the plurality of connector portions in excess of the plurality of product pushers, so only selected ones of the connector portions are used for any particular arrangement of product pushers.

In the first aspect the divider insert typically has a plurality of parallel upright divider walls and is sized to releasably fit within the tray, thereby forming channels atop the tray. A plurality of product pushers are releasably connected to the tray in the channels. Thus, goods to be displayed may be positioned in the channels for the product pusher to urge them to one end of the tray for retail purchase, and the apparatus may be disassembled to arrange a different divider insert and a plurality of product pushers differently in the tray.

In a preferred embodiment according to the first aspect the tray has an outwardly facing forward fascia and a card channel in the fascia and a transparent portion above the card channel.

The tray may have upwardly-facing female connector portions, with the product pushers having downwardly-facing male connector portions. The divider insert has holes positioned to permit the male connectors to engage the female connectors through the holes. In a preferred embodiment according to the first aspect the tray has two parallel, elongated, upwardly-facing female connectors extending continuously across a substantial width of the tray, each of the product pushers has downwardly-facing male connectors spaced apart the distance between the female connectors, and the divider insert has holes spaced apart the distance between the female connectors and centered in the channels, to permit the male connectors to engage the female connectors through the holes.

Preferably, the tray has a tray bottom, including a flat portion and a curved portion, with the curved portion forward of the flat portion. If so, the divider insert may have a base portion, including a flat portion and a curved portion, with the curved portion forward of the flat portion. Preferably, protrusions from an underside of the tray are provided to engage crosswise-extending bars in a supporting shelf assembly. The tray may have peripheral sidewall portions to restrain movement of the divider insert.

In one embodiment according to the first aspect, the divider insert has a base portion slightly smaller than the tray and upright walls at edges of the base portion. Preferably, the divider insert has openings in the channels and the product pushers include tracks having lower portions which fit in the channel openings. Rails may protrude upwardly from the base portion in the channels to reduce friction with product urged by the product pusher.

Preferably, the product pusher includes a track on which pushed product is guided to the one end of the tray, a movable member adapted for movement along the track toward and away from the one end and a spring arranged to urge the movable member toward the one end. Desirably, the track has lower portions adapted to engage the tray and end portions adapted to engage the divider insert. Preferably, the track has rails formed on an upper surface thereof to reduce friction with product urged by the product pusher.

The tray may have two parallel, elongated, upwardly-facing female connector portions extending continuously across a substantial width of the tray, each female connector portion being made up of two juxtaposed elongate strips of resilient material. Each of the product pushers has downwardly-facing male connector portions spaced apart the distance between the female connectors in the form of a rigid tab, and the divider insert has holes spaced apart the distance between the female connectors and centered in the channels. This permits the tabs to engage the juxtaposed resilient strips through the holes, so the strips frictionally engage the tabs to hold the product pushers in place on the divider insert.

Preferably, the rails protrude upwardly from the track at the same height as the rails in the divider insert to reduce friction with product urged by the movable member.

In the second aspect the invention includes a tray including a plurality of connector portions formed across a width of the tray. A plurality of product pushers are releasably connected to the tray and positioned in the tray in reference to the location means. The plurality of product pushers is fewer than the plurality of connector portions, so that only selected ones of the connector portions are used for any particular arrangement of product pushers. Thus, goods to be displayed may be positioned forwardly of the product pushers to urge them to one end of the tray for retail purchase and the apparatus may be disassembled to arrange the plurality of product pushers differently in the tray. In many respects the tray is similar to the tray of the first aspect. That is, the tray may have an outwardly facing forward fascia and a card channel in the fascia. The tray may have a tray bottom, including a flat portion and a curved portion, with the curved portion forward of the flat portion. There may be protrusions from an underside of the tray adapted to engage crosswise-extending bars in a supporting shelf assembly.

In one embodiment of the second aspect, the connector portions in the tray are recesses and the product pushers have downwardly-facing male connectors to permit the male connectors to be engaged within a selected recess. If desired, a template may be interposed between the tray and the product pushers, the template having holes to permit the male connectors to engage the recesses through the holes.

In typical embodiments of the second aspect, the product pusher has a track on which pushed product is guided to the one end of the tray, a movable member adapted for movement along the track toward and away from the one end and a spring arranged to urge the movable member toward the one end. The track has end portions adapted to engage the tray. Preferably, the track has rails formed on an upper surface thereof to reduce friction with product urged by the product pusher. The track may have a cutout portion and a tab extending into the cutout portion so that the track can be released from the tray by raising the tab. Preferably, the track has a lateral extension with an upstanding sidewall.

The invention also provides an apparatus for displaying packages in a retail environment which includes a rack having vertical sidewalls and a bar interconnecting the sidewalls. A tray has protrusions from an underside thereof adapted to engage the bar to support the tray in a first, retracted, package-displaying position and a second, extended, package-loading position. The tray contents may be as described above with respect to either aspect.

The invention also provides methods of displaying goods in a retail environment. According to one aspect the method includes the steps of releasably inserting a divider insert into a tray, the divider insert including a plurality of parallel upright divider walls, and thereby forming channels atop the tray, releasably connecting a plurality of product pushers to the tray in the channels, and positioning goods in the channels so that the product pusher urges them to one end of the tray for retail purchase. The method may also include disassembling the product pusher, divider insert and tray and arranging a different divider insert and a plurality of pushers differently in the tray.

In a preferred embodiment according to the first aspect, the method includes inserting product information into a card channel on the front of the tray so that different product-specific information is aligned with each channel. It may also include installing a transparent portion on the front of the tray.

In one embodiment the product pusher connection step includes inserting downwardly-facing male connector portions on the product pushers into upwardly-facing female connector portions in the tray, through holes in the divider insert. In a preferred embodiment the connector insertion step includes frictionally engaging the male connectors with the female connectors.

In a preferred embodiment the method also includes loading the tray into a rack having vertical sidewalls and a bar interconnecting the sidewalls, and securing the tray on the bar with protrusions from an underside of the tray. The goods-positioning step may include lowering the tray to a point where other protrusions engage the lower front bar to hold the tray in place extended from the rack.

Preferably, the product pusher connecting step includes aligning lower pusher tracks with openings in the channels.

The goods positioning step may include retracting a movable member on the product pusher along a track against the force of a spring to make room for product to be guided to the forward end of the tray.

The invention also includes a method of displaying goods in a retail environment including releasably inserting a divider insert into a tray, the divider insert including a plurality of parallel upright divider walls, and thereby forming channels atop the tray, releasably connecting a plurality of product pushers to the tray in the channels, inserting product information into a card channel on the front of the tray, so that different product-specific information is aligned with each channel, loading the tray into a rack having vertical sidewalls and a bar interconnecting the sidewalls, and securing the tray on the bar with protrusions from an underside of the tray. The method proceeds by positioning goods in the channels so that the product pusher urges them to one end of the tray for retail purchase, including lowering the tray to a point where other protrusions engage the bar to hold the tray in place extended from the rack. It may subsequently include disassembling the product pusher, divider insert, tray, and product information and arranging a different divider insert and product information and a plurality of pushers differently in the tray.

A method according to a second aspect includes releasably connecting a plurality of product pushers including a plurality of parallel upright divider walls to a tray, and thereby forming channels atop the tray, and positioning goods in the channels so that the product pusher urges them to one end of the tray for retail purchase. The method may include the additional step of disassembling the product pusher and tray and arranging the plurality of pushers differently in the tray.

It may also include inserting product information into a card channel on the front of the tray, with different product-specific information being aligned with each channel.

Preferably, the product pusher connection step includes inserting downwardly-facing male connectors on the product pushers into recesses in the tray. This step may also include inserting the male connectors through holes in a template.

The method may include loading the tray into a rack having vertical sidewalls and a bar interconnecting the sidewalls, and securing the tray on the upper rearward bar with protrusions from an underside of the tray. The goods-positioning step may include lowering the tray to a point where other protrusions engage the bar to hold the tray in place extended from the rack.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
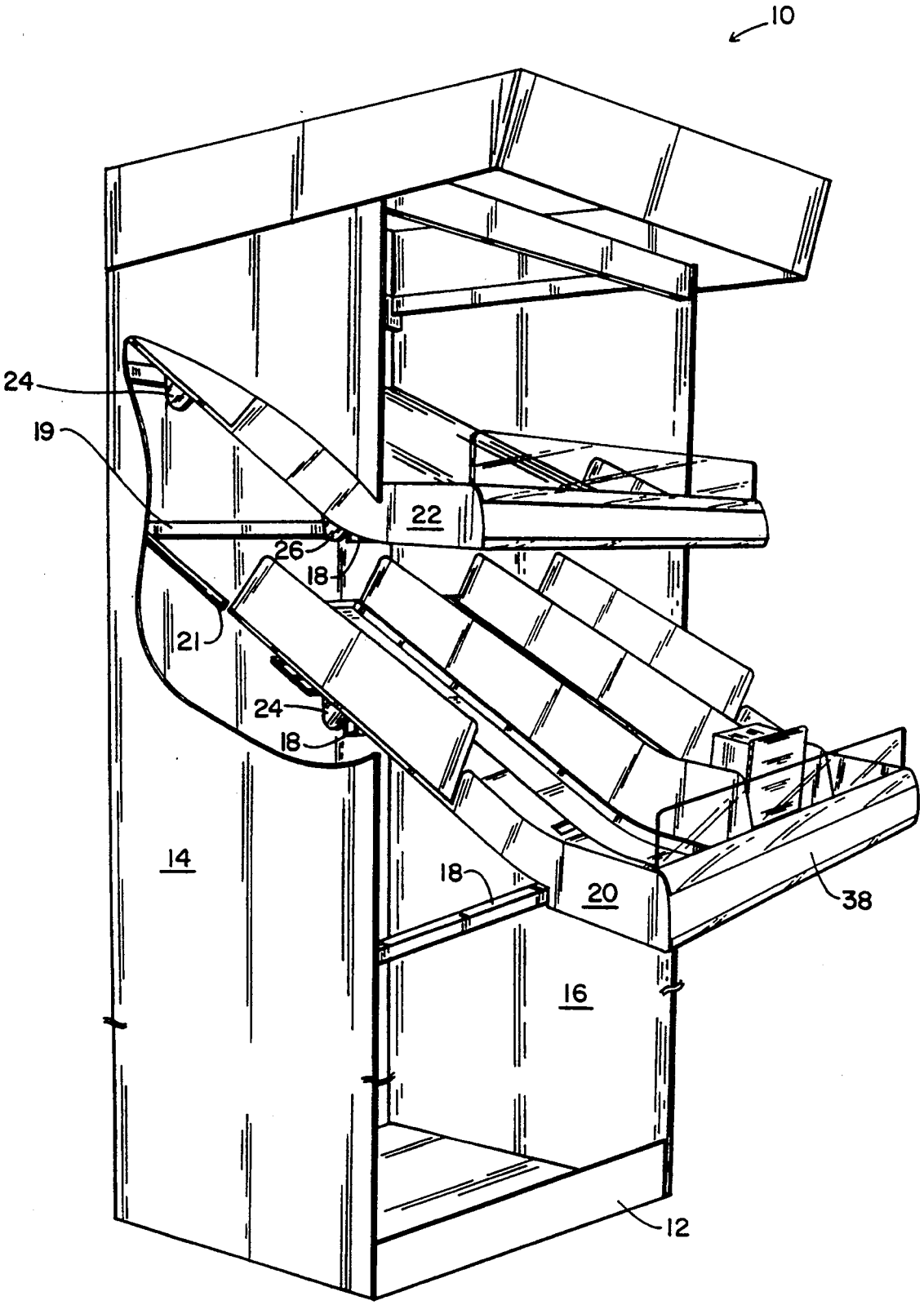
FIG. 1 is a perspective view of a retail rack including apparatus according to an embodiment of the first aspect of the invention.

Referring now to FIG. 1, a display rack 10 for a product is depicted. As shown in FIG. 1, the product is set up as a point-of-purchase pusher display for packages of pantyhose. Of course, the product to be dispensed and sold is not material, and the various components of the invention can be suitably sized and shaped to accommodate the product being dispensed.

The rack 10 includes a base 12 and side walls 14, 16. A plurality of front bars 18 interconnect the side walls to provide rigidity to the rack 10 and for further purposes to be described. Similarly, rear bars 19 provide additional rigidity. Slantedly arranged between a front bar and a rear, higher bar are side rails 21. The side rails 21 provide support for the display assemblies, such as display assemblies 20,22. The display assembly includes trays 30 which have lower protrusions 24,26. These protrusions are located on the trays so as to provide a backstop for the tray against the front bars 18. Thus, as can be seen in FIG. 1, the protrusion 26 of the assembly 22 engages the bar 18 to hold the upper assembly 22 retracted in the rack 10. The lower assembly 20 is held in an extended position by the abutment of the protrusion 24 against its bar 18.

Thus, each of the assemblies 20,22 can have either of the positions shown in the drawing. In the extended position such as depicted with respect to assembly 20, the channel portions of the assembly are exposed so store personnel cam easily restock the merchandise. The retracted position as shown with respect to assembly 22 makes an attractive and compact display of the product for the customers.

Figure 2:
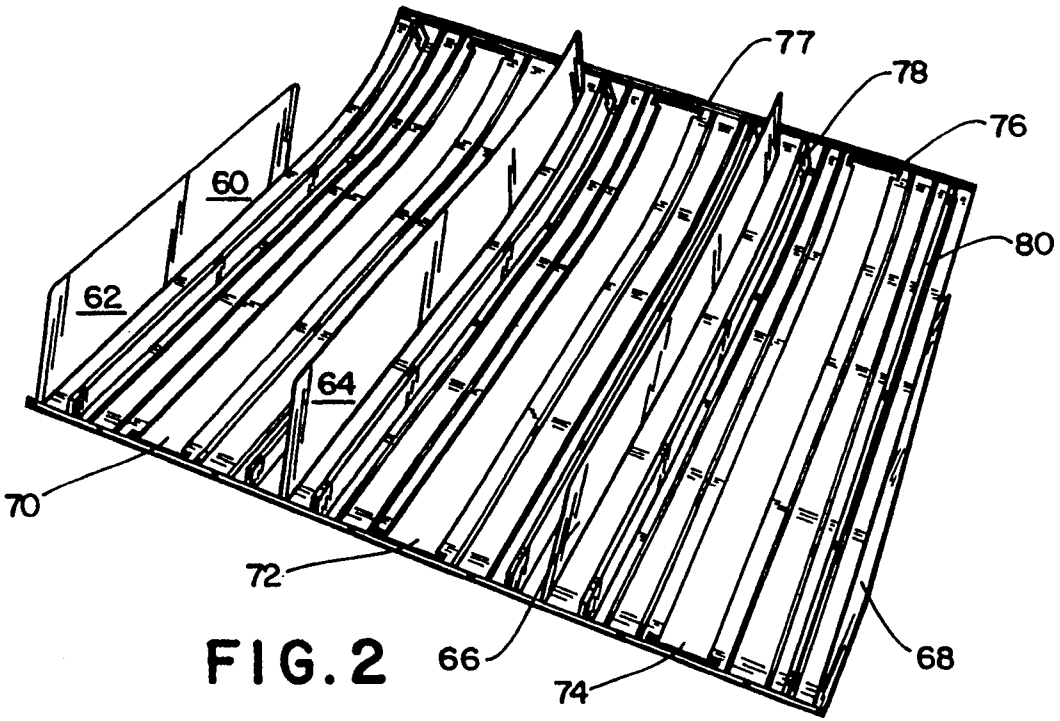
FIG. 2 is a perspective view of the divider insert component of the display of the invention.
Figure 5:
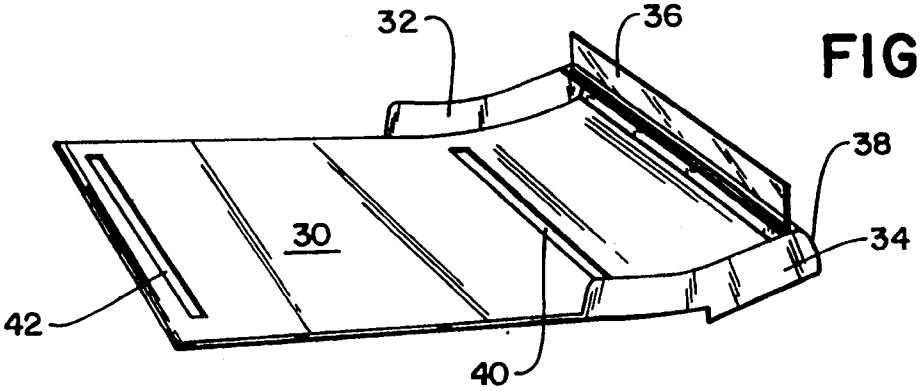
FIG. 5 is a perspective view of the tray component.
Figure 6:
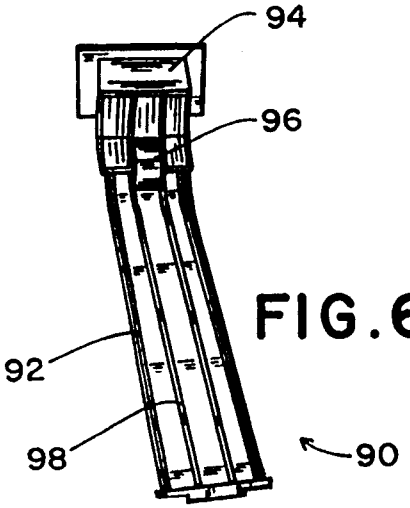
FIG. 6 is a perspective view of the track element of the product pusher component for the second aspect.
Figure 3:
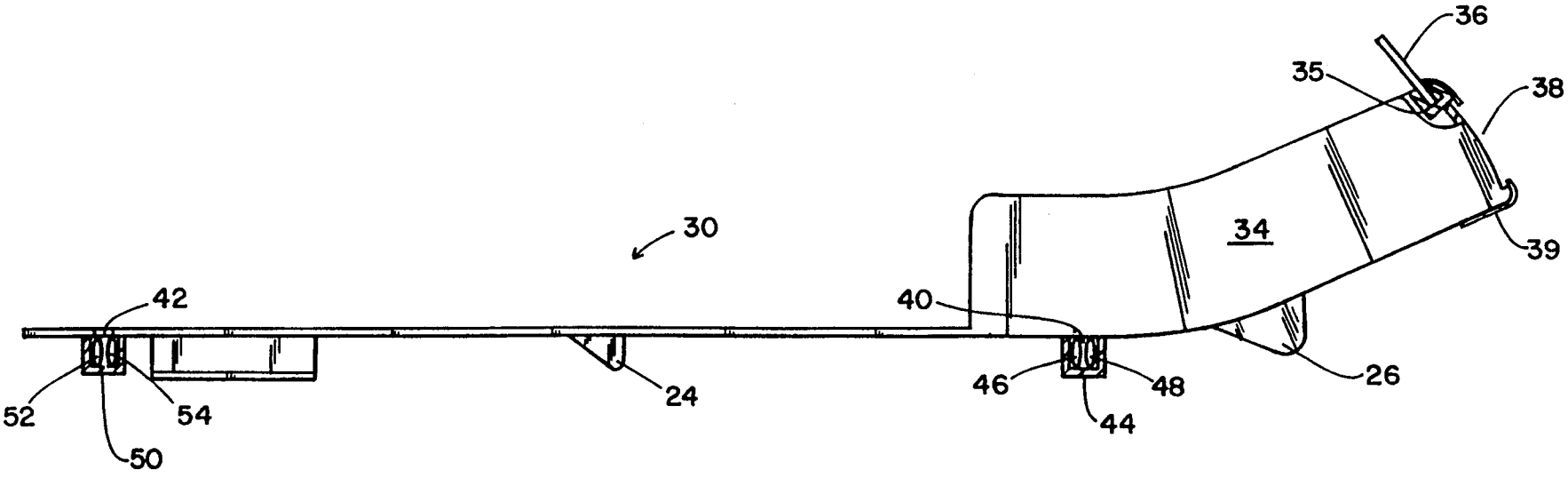
FIG. 3 is side elevation view of the tray components.

FIGS. 2, 5 and 6 illustrate the three main components of one of the assemblies 20,22 in perspective. The assembly includes a tray 30 having side walls 32,34, a front-facing card channel 38 and a transparent product hold-back portion 36 above the card channel. Laterally extending female connector portions 40,42 are provided in lower and upper portions of the tray 30. More details of the tray can be seen in FIG. 3, a side elevation view of the tray. Thus, the card channel 38 is formed by a cowl 39 glued over a formed depression to make a "raise and drop" card channel extending all across the front of the tray. One card can be printed having several items of product-specific information, each arrayed in a width corresponding to a channel width, to identify merchandise in the channel behind that portion of the card. Also visible in FIG. 3 are the protrusions 26,24 discussed above with respect to FIG. 1.

The lower female connector portion 40 is made up of a formed groove 44 in the tray portion and two juxtaposed resilient members 46,48. Similarly, the upper female connector portion is made up of the formed groove 50 and juxtaposed resilient elements 52,54.

Referring back to FIG. 2, a divider insert is shown, sized to be slightly smaller than and therefore to be able to fit into the tray 30. The divider insert 60 is shown having side wall portions 62,68 which extend rearwardly of the corresponding side walls 32,34 of the tray 30 when the insert is located in the tray. Of course, numerous variations of the relative sizes of the side wall in the tray and divider insert may be contemplated. The divider insert also has interior dividers 64,66. Thus, a channel is formed between, on the one hand, the side walls 32,62 and the wall 64. Similar channels are formed between the other dividers and side walls.

Each channel is provided with a longitudinally extending hole, such as holes 70,72,74. Preferably, the holes extend the entire length of the channels, however, they could merely be located to overlay the female connector portions 40,42 when the divider insert is located in the tray 30. The divider insert preferably has wider portions for the holes forwardly and rearwardly, such as the widened portions 76 for the hole 74 shown in the drawing. Rails 78,80 are provided in each of the channels for the purpose of reducing friction in the movement of product along the channel. The tray 30 is provided with rearwardly extending boss 35 and the divider insert 60 is provided with a forward raised portion 77 to assist in locking the divider insert in position in the tray 30 by fitting under the boss 35.

The divider insert 60 is shown defining three channels of a specific width, but the invention specifically contemplates other numbers of channels, with each channel as wide as the product to be dispensed and sufficient in number to extend the width of the tray 30. In addition, the channels need not all be the same size, and some tray space may remain unused, although that is not preferred.

Figure 4:
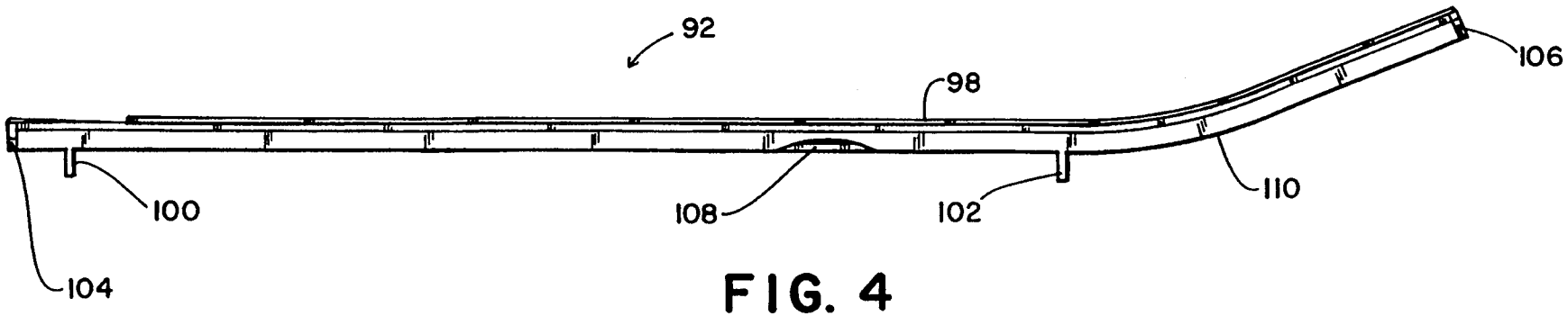
FIG. 4 is a side elevation view of the track element of the product pusher component.

The third component of the assembly is a product pusher 90, as seen in FIG. 6. The product pusher 90 includes a track element 92, a pusher element 94, and a spring 96. FIG. 6 is a rear perspective view of the product pusher. The spring 96 has its outer, free end secured in a front portion of the track element in a conventional fashion, and the coiled portion of the spring engages the rear of the pusher element 94 to push it toward the front. The track element includes rails 98 formed in the top of it, again to reduce friction for the product being moved along the track. The rails also provide a bed in which the spring can be housed to as to prevent the spring from interfering with the product resting on the track element. Further details of the track element 92 can be seen in the side view shown in FIG. 4. Protruding downwardly from the track are male connector portions 100, 102, spaced apart a distance substantially identical to the distance between the female connector portions 40,42 of the tray 30. The male portions 100, 102 may be simply flat tabs of substantial thickness which, when depressed into the female connector portions 40,42 are frictionally engaged by the juxtaposed resilient materials in the female connector portions. In addition, the track element 92 has a lower longitudinal ridge 110 which is sized to fit within any one of corresponding holes 72,74 in a secure fit. Similarly, lips 104, 106 are provided at the ends of the track element 92 to fit into the widened portions at the ends of the holes in the divider insert, such as the widened portion 76.

The assemblies 20,22 may be shipped from a plant to a retail environment completely assembled, or for field assembly. Each assembly includes a tray, a divider insert, and as many product pushers as there are channels in the divider insert. The parts are put together simply. First, the divider insert 60 is located in the tray 30 so that is has a snug fit. The divider insert defines the channel size and has centrally located holes which overlie the female connector portions 40,42 of the tray. Thus, there is only possible mounting for a product pusher in each channel. The product pusher for each channel is located properly by fitting its longitudinal ridge 110 in the respective elongated hole in the divider insert, for example, hole 74, with the forward lip 106 engaging in the widened hole portion 76. When this happens, the male connector elements 100,102 will be securely located in the corresponding female connector portions 40,42. That completes the pusher assembly for the channel. The identical product pusher assembly steps are taken with respect to the other channels for the divider insert.

The assembly can then be loaded into the rack 10 and used in the retailing of the products desired. The tray assemblies may be lowered, as discussed above, for reloading or retracted for normal retail operation. Should it be desired to dispense a different product or the same product in a different size package, the apparatus very readily enables that to take place. That is, if, for example, the product width is to be decreased by one-fourth, then four side-by-side packages will fit in the tray 30. All that need be done is to use a new divider insert and an additional product pusher. The new divider insert would be made substantially as the one shown in FIG. 2, except with four, rather than three, channels and have them narrower. The old product pushers can still be used along with the new, fourth one, and all four will be properly positioned in the corresponding channels and locked properly in the corresponding female connector portions 40,42 by virtue of the predetermined location of the product pushers in the new divider insert. In addition, since the card channel 38 extends across the entire tray width, a new card can be provided along with the new divider insert. The new card can be provided with product identifying information corresponding to the new widths of the channels of the new divider insert so that, when installed in the forward card channel, it lines up with the channel extending behind it.

The invention also has the advantage that, by providing a new divider insert for each new package size, the rails 78,80 are always located at a proper position to minimize friction. Also, the pusher element 94 will always be located in the center of the channel, because the holes 70,72,74 can always be located centrally of the channel. This eliminates any binding which may occur if the product were being pushed from the side or other offset position.

The invention also includes variations on the embodiment as specifically disclosed herein. In particular, the holes in the middles of the channels need not be elongated or extend the majority the length of the channel, but could be simply located over the locations of the female connector portions 40,42, with appropriate modifications to the configuration of the ridge 110.

As can be seen, an advantage of the present invention is that the lower front portion of the tray assembly is curved so that it is no longer slanted facing downwardly, but faces horizontally so that, as the customer approaches the display, the product being displayed is easy to see.

Other types of connections between the tracks of the product pusher and the tray, other than the specific male and female connector portions described herein, may be substituted. In particular, snaps are contemplated. The height of the divider walls for the divider insert can be minimal, and the materials used can be thin and inexpensive, since this is a disposable component. The tray, pusher track, pusher element and divider insert are desirably made of molded high-impact polystyrene.

The tray can be of varying widths, with widths of 18" up to 4 feet being specifically contemplated. Preferably, the rails 78,80 and the rails 98 in the top of the pusher track are formed to be at the same elevation in the assembled tray assembly.

Figure 8:
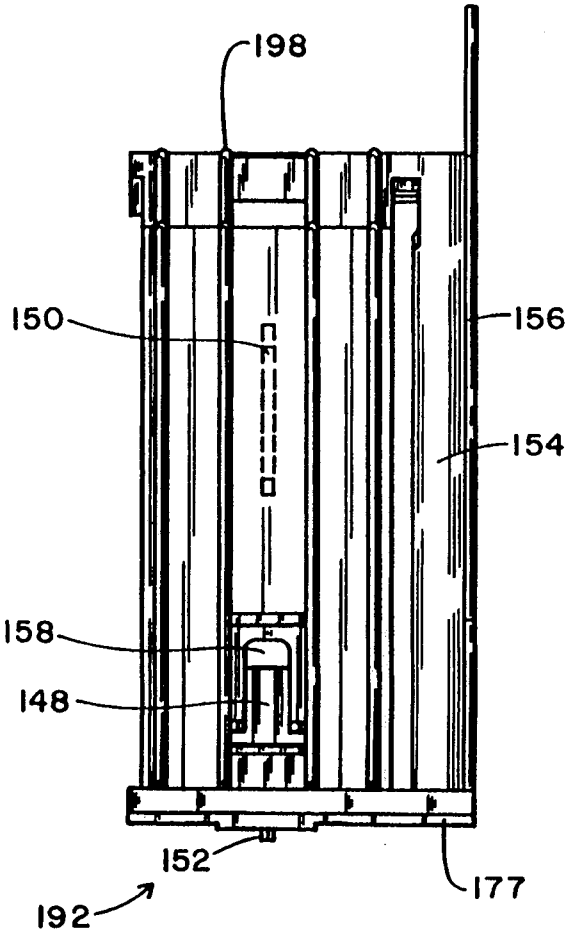
FIG. 8 is a top plan view of the track element of the product pusher component for use with the tray of FIG. 7.
Figure 7:
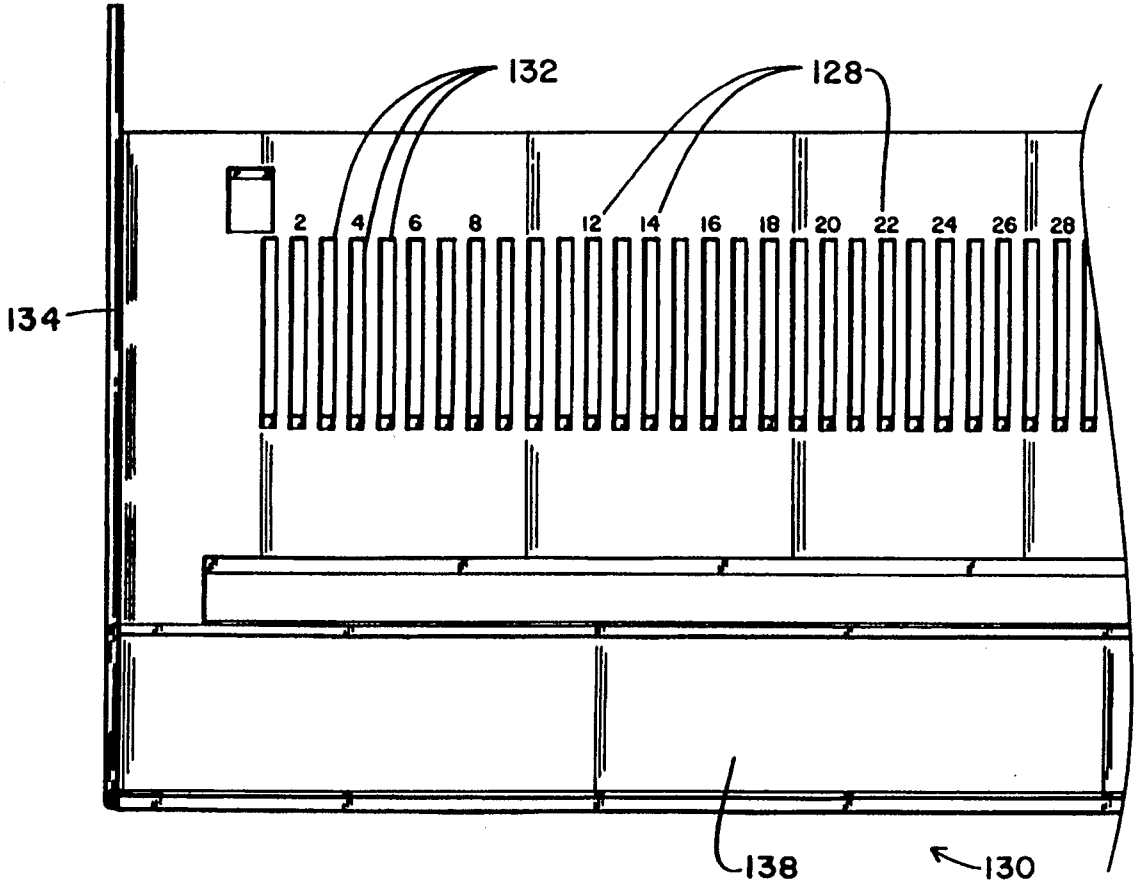
FIG. 7 is a front elevation view of one end of the tray component of an embodiment according to the second aspect, the remainder of the tray being broken away.
Figure 9:
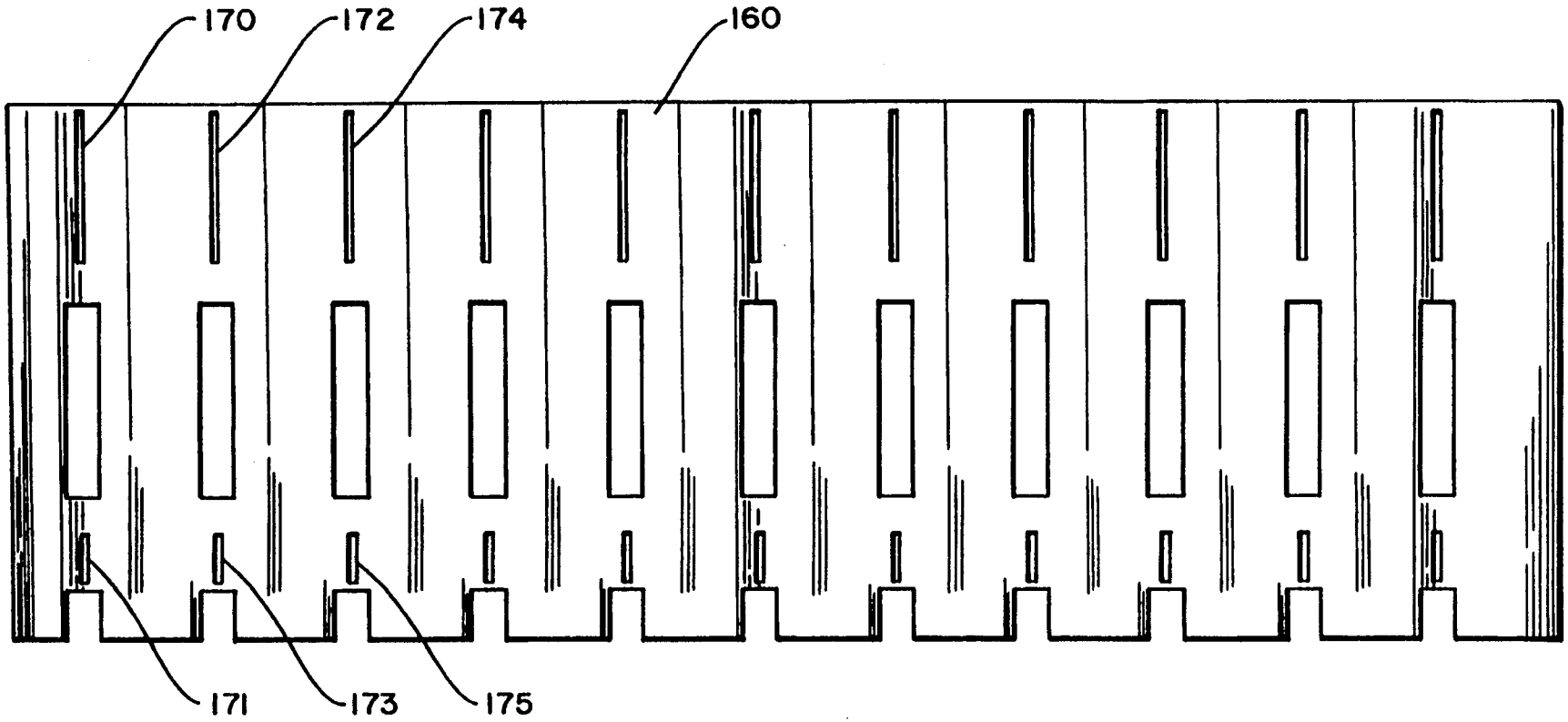
FIG. 9 is a top plan view of a template for optional use with the tray of FIG. 7.

FIGS. 7,8 and 9 illustrate the three main components of an embodiment according to the second aspect. As seen in FIG. 7 tray 130 has side walls 134 and a front-facing card channel 138. The card channel can receive a full-width card, like the cards described above with respect to the first aspect. A transparent product hold-back portion (not shown) can also be provided above the card channel. A plurality of recesses 132 are provided arrayed across the width of the tray. Similar recesses are also provided lower on the tray than those seen in FIG. 7, occluded by the card channel 138.

The recesses 132 are formed as depressions in the tray and are identified by labelling, such as numbers 128.

FIG. 8 shows a top view of a track element of a product pusher 190 for an embodiment according to the second aspect. The product pusher includes the track element 192, a pusher element, and a spring. The pusher element and the spring can be the same as those shown for the first aspect. The track element 192 includes rails 198 formed in the top of it, again to reduce friction for the product being moved along the track. The rails also provide a bed in which the spring can be housed to as to prevent the spring from interfering with the product resting on the track element. Protruding downwardly from the track are male connector portions 150,152. Portion 150 is shown in phantom because it protrudes away from the viewer of the figure. The portions 150, 152 are sized to fit into the recesses 132 in the tray in a secure fit. As can be appreciated, the portions 152 fit into the recesses occluded by card channel 138 in FIG. 7. The tray 130 has a rearwardly extending boss, like the boss 35 of the tray of the first aspect, and the track elements have portions 177 to assist in locking the track elements in position in the tray 130 by fitting under the boss.

Each track element is provided with a lateral extension portion 154 having a raised sidewall 156 at its edge. Thus, locating the track elements in the tray defines channels between the sidewalls of adjacent track elements. Of course, the track element at the end of the tray need not have a side wall if the tray sidewall suffices. Alternatively, the tray need not have a sidewall on the end where the track element's sidewall will be positioned. Also, whether the sidewalls are on the right or left side of the track elements is immaterial, as long as there is consistency in placement.

The track element 192 is provided with a cutout 158 and a molded-in tab 148 extending into the space of the cutout. Thus, the tab can be used to grip the track element to pull it upwardly when the track element is to be removed from the tray.

The parts are put together simply. The product pushers and tray are accompanied by instructions for the proper placement of the product pushers in the tray. For example, the instructions may say to locate a product pusher in each of the recesses labeled as 4, 14, 24, 34, 44 etc. to achieve a channel width for the products comparable to the spacings between the spaces 4 and 14. Then, the store employee may locate the product pusher for each channel by fitting its male connector 150 into the enumerated recess in the tray with the forward lip 177 engaging under the boss of the tray. That completes the pusher assembly for the channel. The identical product pusher assembly steps are taken with respect to the other channels.

Alternatively, the product pushers may be installed with a template as a guide. FIG. 9 is a plan view of a template 160. The template is sized to be slightly smaller than and therefore to be able to fit into the tray 130 without sideways movement when it is in the tray. The template 160 is preferably a thin sheet—for example 1/32" thick, so that it does not interfere with the product pusher's obtaining a secure mounting the tray. The template helps in properly locating the product pusher. To do this, the template 160 is provided with a plurality of longitudinally extending holes, such as holes 170, 171, 172, 173, 174, 175. The upper holes 170, 172, 174 . . . are located to overlay selected ones of the recesses 132 when the template is located in the tray 130. The lower holes 171, 173, 175 . . . are located to overlay selected ones of the recesses occluded by the card channel 138 when the template is located in the tray 130. Other holes may be provided as shown to facilitate other engagements of the product pushers to the tray, as desired. When the template 160 is located in the tray 130, it has a snug fit. Thus, there is only possible mounting for a product pusher. The process can proceed as described above, using the exposed holes, rather than the numbers 128 as the guides for mounting the product pushers.

The assembly can then be loaded into the rack 10 and used in the retailing of the products desired, as discussed above, with respect to the first aspect. Should it be desired to dispense a different product or the same product in a different size package, the apparatus very readily enables that to take place. That is, if, for example, the product width is to be decreased by one-fourth, then four side-by-side packages will fit in the tray 130. If the numerical guides 128 are being used, all that need be done is to use an additional product pusher, and instruct the field personnel which of the guides 128 are to be used. If the template mode is being used, a new template would be made substantially as the one shown in FIG. 9, except with the holes 170, 172 . . . located where the product pushers are to be mounted. The old product pushers can still be used along with any new ones needed.

In addition, since the card channel 138 extends across the entire tray width, a new card can be provided along with the instructions for re-deploying the product pushers or the new template. The new card can be provided with product identifying information corresponding to the new widths of the channels so that, when installed in the forward card channel, it lines up with the channel extending behind it.

Those of ordinary skill in the art will appreciate that the invention may be carried out with various other modifications still within the scope of the present invention.

What is claimed is:

1. An apparatus for displaying goods in a retail environment comprising a tray, a divider insert including a plurality of parallel upright divider walls, said divider insert being sized to releasably fit within said tray, thereby forming channels atop said tray, and a plurality of product pushers releasably connected to said tray in said channels, whereby goods to be displayed may be positioned in said channels for said product pusher to urge them to one end of said tray for retail purchase and the apparatus may be disassembled to arrange a different divider insert and a plurality of pushers differently in said tray.

2. An apparatus as claimed in claim 1 wherein said tray has an outwardly facing forward fascia and a card channel in said fascia.

3. An apparatus as claimed in claim 2 wherein said fascia has a transparent portion above said card channel.

4. An apparatus as claimed in claim 1 wherein said tray has upwardly-facing female connectors, said product pushers, have downwardly-facing male connectors, and said divider insert has holes positioned to permit said male connectors to engage said female connectors through said holes.

5. An apparatus as claimed in claim 1 wherein said tray has two parallel, elongated, upwardly-facing female connectors extending continuously across a substantial width of said tray, each of said product pushers has downwardly-facing male connectors spaced apart the distance between said female connectors, and said divider insert has holes spaced apart the distance between said female connectors and centered in said channels, to permit said male connectors to engage said female connectors through said holes.

6. An apparatus as claimed in claim 1 wherein said tray has tray bottom, including a flat portion and a curved portion, with said curved portion forward of said flat portion.

7. An apparatus as claimed in claim 6 comprising protrusions from an underside of said tray adapted to engage crosswise-extending bars in a supporting shelf assembly.

8. An apparatus as claimed in claim 1 wherein said tray has peripheral sidewall portions to restrain movement of said divider insert.

9. An apparatus as claimed in claim 1 wherein said divider insert comprises a base portion slightly smaller than said tray and including upright walls at edges of said base portion.

10. An apparatus as claimed in claim 1 wherein said divider insert has openings in said channels and said product pushers include tracks having lower portions which fit in said channel openings.

11. An apparatus as claimed in claim 1 wherein said divider insert has a base portion and rails protruding upwardly from said base portion in said channels to reduce friction with product urged by said product pusher.

12. An apparatus as claimed in claim 1 wherein said divider insert has a base portion, including a flat portion and a curved portion, with said curved portion forward of said flat portion.

13. An apparatus as claimed in claim 1 wherein said product pusher comprises a track on which pushed product is guided to said one end of said tray, a movable member adapted for movement along said track toward and away from said one end and a spring arranged to urge said movable member toward said one end.

14. An apparatus as claimed in claim 13 wherein said track has lower portions adapted to engage said tray and end portions adapted to engage said divider insert.

15. An apparatus as claimed in claim 13 wherein said track has rails formed on an upper surface thereof to reduce friction with product urged by said product pusher.

16. An apparatus as claimed in claim 1 wherein said tray has two parallel, elongated, upwardly-facing female connectors extending continuously across a substantial width of said tray, each said female connector comprising two juxtaposed elongate strips of resilient material, each of said product pushers has downwardly-facing male connectors spaced apart the distance between said female connectors, each said male connector being in the form of a rigid tab, and said divider insert has hole portions spaced apart the distance between said female connectors and centered in said channels, to permit said tabs to engage said juxtaposed resilient strips through said holes, whereby said strips frictionally engage said tabs to hold said product pushers in place on said divider insert.

17. An apparatus as claimed in claim 1 wherein said tray has a tray bottom, including a flat portion and a curved portion, with said curved portion forward of said flat portion and protrusions from an underside of said tray adapted to engage crosswise-extending bars in a supporting shelf assembly, peripheral sidewall portions to restrain movement of said divider insert, and said divider insert has a base portion slightly smaller than said tray, upright walls at edges of said base portion, and openings in said channels, and said product pushers include tracks having lower portions which fit in said channel openings.

18. An apparatus as claimed in claim 1 wherein said divider insert comprises a base portion and rails protruding upwardly from said base portion in said channels to reduce friction with product urged by said product pusher, said product pusher comprises a track on which pushed product is guided to said one end of said tray, a movable member adapted for movement along said track toward and away from said one end, a spring arranged to urge said movable member toward said one end and, rails protruding upwardly from said track at the same height as said rails in said divider insert to reduce friction with product urged by said movable member.

19. An apparatus for displaying goods in a retail environment comprising a. a tray including 1) an outwardly facing forward fascia, a card channel in said fascia, and a transparent portion above said card channel, 2) two parallel, elongated, upwardly-facing female connectors extending continuously across a substantial width of said tray, 3) a tray bottom, including a flat portion and a curved portion, with said curved portion forward of said flat portion, 4) protrusions from an underside of said tray adapted to engage crosswise-extending bars in a supporting shelf assembly, and 5) peripheral sidewall portions.

b. a divider insert having a base portion slightly smaller than said tray and including a flat portion and a curved portion, with said curved portion forward of said flat portion, 1) a plurality of parallel upright divider walls which form channels atop said tray, 2) holes exposing said female connectors and centered in said channels, 3) rails protruding upwardly from said base portion in said channels, c. a plurality of product pushers releasably connected to said tray in said channels including 1) tracks on which pushed product is guided to said one end of said tray and having lower portions which fit in said channel openings and rails formed on an upper surface thereof to reduce friction with product urged by said product pusher, 2) downwardly-facing male connectors spaced apart the distance between said female connectors for engagement with said female connectors, 3) a movable member adapted for movement along said track toward and away from said one end, 4) a spring arranged to urge said movable member toward said one end, and 5) end portions adapted to engage said divider insert, whereby goods to be displayed may be positioned in said channels for said product pusher to urge them to one end of said tray for retail purchase and the apparatus may be disassembled to arrange a different divider insert and a plurality of pushers differently in said tray.

20. An apparatus for displaying packages in a retail environment comprising a rack having vertical sidewalls and a bar interconnecting said sidewalls, a tray having a first protrusion from an underside thereof adapted to engage said bar to support said tray in a first, retracted package-displaying position, a second protrusion adapted to engage said bar to support said tray in a second, extended, package-loading position, and a plurality of location means across a width of said tray, a plurality of product pushers releasably connected to said tray and positioned in said tray in reference to said location means, whereby packages to be displayed may be positioned in said channels for said product pusher to urge them to one end of said tray for retail purchase while said tray is in said first position, packages may be reloaded into the apparatus when said tray is in said second position and the apparatus may be disassembled to arrange a different divider insert and a plurality of pushers differently in said tray.

21. An apparatus as claimed in claim 20 wherein said tray has a tray bottom, including a flat portion and a curved portion, with said curved portion forward of said flat portion.

22. A method of displaying goods in a retail environment comprising the steps of releasably inserting a divider insert into a tray, the divider insert including a plurality of parallel upright divider walls, and thereby forming channels atop the tray, releasably connecting a plurality of product pushers to the tray in the channels, and positioning goods in the channels so that the product pusher urges them to one end of the tray for retail purchase.

23. A method as claimed in claim 22 further comprising disassembling the product pusher, divider insert and tray and arranging a different divider insert and a plurality of pushers differently in the tray.

24. A method as claimed in claim 22 further comprising inserting product information into a card channel on the front of the tray, with different product-specific information being aligned with each channel.

25. A method as claimed in claim 22 further comprising installing a transparent portion on the front of the tray.

26. A method as claimed in claim 22 wherein said product pusher connection step comprises inserting downwardly-facing male connectors on the product pushers into upwardly-facing female connectors in the tray, through holes in the divider insert.

27. A method as claimed in claim 26 said connector insertion step comprises frictionally engaging the male connectors with the female connectors.

28. A method as claimed in claim 22 further comprising loading the tray into a rack having vertical sidewalls and a bar interconnecting the sidewalls, and securing the tray on the upper rearward bar with protrusions from an underside of the tray.

29. A method as claimed in claim 28 wherein said goods-positioning step includes lowering the tray to a point where other protrusions engage the bar to hold the tray in place extended from the rack.

30. A method as claimed in claim 22 wherein said product pusher connecting step includes aligning lower pusher tracks with openings in the channels.

31. A method as claimed in claim 22 wherein the goods positioning step includes retracting a movable member on the product pusher along a track against the force of a spring to make room for product to be guided to the forward end of the tray.

32. A method of displaying goods in a retail environment comprising the steps of releasably inserting a divider insert into a tray, the divider insert including a plurality of parallel upright divider walls, and thereby forming channels atop the tray, releasably connecting a plurality of product pushers to the tray in the channels, inserting product information into a card channel on the front of the tray so that different product-specific information is aligned with each channel, loading the tray into a rack having vertical sidewalls and a bar interconnecting the sidewalls, and securing the tray on the bar with protrusions from an underside of the tray, positioning goods in the channels so that the product pusher urges them to one end of the tray for retail purchase, including lowering the tray to a point where other protrusions engage the lower front bar to hold the tray in place extended from the rack, and subsequently disassembling the product pusher, divider insert, tray, and product information and arranging a different divider insert and product information and a plurality of pushers differently in the tray.

33. An apparatus for displaying goods in a retail environment comprising a tray including a plurality of upwardly-facing recesses formed across a width of said tray, a plurality of product pushers having downwardly-facing male connectors releasably connected to selected ones of said recesses in said tray and positioned in said tray in reference to said recesses, said plurality of product pushers being fewer than said plurality of recesses, so that only selected ones of said recesses are used for any particular arrangement of product pushers, and a template interposed between said tray and said product pushers, said template having holes to permit said male connectors to engage said recesses through said holes, whereby goods to be displayed may be positioned forwardly of said product pushers to urge them to one end of said tray for retail purchase and the apparatus may be disassembled to arrange the plurality of product pushers differently in said tray with a different template.

34. An apparatus as claimed in claim 33 wherein said tray has an outwardly facing forward fascia and a card channel in said fascia.

35. An apparatus as claimed in claim 33 wherein said tray has a tray bottom, including a flat portion and a curved portion, with said curved portion forward of said flat portion.

36. An apparatus as claimed in claim 35 comprising protrusions from an underside of said tray adapted to engage crosswise-extending bars in a supporting shelf assembly.

37. An apparatus as claimed in claim 33 wherein said product pusher comprises a track on which pushed product is guided to said one end of said tray, a movable member adapted for movement along said track toward and away from said one end and a spring arranged to urge said movable member toward said one end.

38. An apparatus as claimed in claim 37 wherein said track has end portions adapted to engage said tray.

39. An apparatus as claimed in claim 37 wherein said track has rails formed on an upper surface thereof to reduce friction with product urged by said product pusher.

40. An apparatus as claimed in claim 37 wherein said track has a lateral extension with an upstanding sidewall.

41. An apparatus for displaying goods in a retail environment comprising a. a tray including 1) a plurality of upwardly-facing recesses formed across a width of said tray, 2) a tray bottom, including a flat portion and a curved portion, with said curved portion forward of said flat portion, 3) protrusions from an underside of said tray adapted to engage crosswise-extending bars in a supporting shelf assembly, and 4) an outwardly facing forward fascia and a card channel in said fascia, b. a plurality of product pushers, said plurality of product pushers being fewer than said plurality of recesses, so that only selected ones of said recesses are used for any particular arrangement of product pushers, each product pusher comprising 1) a track on which pushed product is guided to said one end of said tray, 2) a movable member adapted for movement along said track toward and away from said one end, 3) a spring arranged to urge said movable member toward said one end, 4) a lateral extension with an upstanding sidewall rails formed on an upper surface thereof to reduce friction with product urged by said movable member, 5) downwardly-facing male connectors to permit said male connectors to be engaged in selected ones of said recesses, thereby releasably connecting said product pusher to said tray, and 6) a cutout portion and a tab extending into said cutout portion so that said track can be released from said tray by raising said tab, and whereby goods to be displayed may be positioned forwardly of said product pushers to urge them to one end of said tray for retail purchase and the apparatus may be disassembled to arrange the plurality of product pushers differently in said tray.

42. A method of displaying goods in a retail environment comprising the steps of releasably connecting a plurality of product pushers including a plurality of parallel upright divider walls to a tray, and thereby forming channels atop the tray, inserting product information into a card channel the front of the tray, with different product-specific information being aligned with each channel, and positioning goods in the channels so that the product pusher urges them to one end of the tray for retail purchase.

43. A method as claimed in claim 42 further comprising disassembling the product pusher and tray and arranging the plurality of pushers differently in the tray.

44. A method as claimed in claim 42 wherein said product pusher connection step comprises inserting downwardly-facing male connectors on the product pushers into upwardly-facing recesses in the tray.

45. A method of displaying goods in a retail environment comprising the steps of releasably connecting a plurality of product pushers including a plurality of parallel upright divider walls to a tray, and thereby forming channels atop the tray, positioning goods in the channels so that the product pusher urges then to one end of the tray for retail purchase, loading the tray into a rack having vertical sidewalls and a bar connecting the sidewalls, and securing the tray on an upper rearward bar connects the sidewalls with protrusions from an underside of the tray.

46. A method as claimed in claim 45 wherein said goods-positioning step includes lowering the tray to a point where other protrusions engage the bar to hold the tray in place extended from the rack.

47. An apparatus for displaying goods in a retail environment comprising a tray including a plurality of connector portions serving as locators formed across a width of said tray, and a plurality of product pushers releasably connected to said tray and positioned in said tray in reference to said locators, said plurality of product pushers being fewer than said plurality of connector portions, so that only selected ones of said connector portions are used for any particular arrangement of product pushers, said product pushers each including a track on which pushed product is guided to said one end of said tray, a movable member adapted for movement along said track toward and away from said one end, and a spring arranged to urge said movable member toward said one end, said track having a cut-out portion and a tab extending into said cut-out portion so that said track can be released from said tray by raising said tab, whereby goods to be displayed may be positioned forwardly of said product pushers to urge the goods to one end of said tray for retail purchase and the apparatus may be disassembled to arrange the plurality of product pushers differently in said tray.

48. An apparatus for displaying goods in a retail environment comprising a tray including a plurality of connector portions serving as locators formed across a width of said tray, and a plurality of product pushers releasably connected to said tray and positioned in said tray in reference to said locators, said plurality of product pushers being fewer than said plurality of connector portions, so that only selected ones of said connector portions are used for any particular arrangement of product pushers, said product pushers each including a track on which pushed product is guided to said one end of said tray, a movable member adapted for movement along said track toward and away from said one end, and a spring arranged to urge said movable member toward said one end, said track having a lateral extension with an upstanding sidewall, whereby goods to be displayed may be positioned forwardly of said product pushers to urge the goods to one end of said tray for retail purchase and the apparatus may be disassembled to arrange the plurality of product pushers differently in said tray.

49. A method of displaying goods in a retail environment comprising the steps of releasably connecting a plurality of product pushers including a plurality of parallel upright divider walls to a tray by inserting downwardly-facing male connectors on the product pushers into upwardly-facing recesses in the tray through holes in a template, and thereby forming channels atop the tray, and positioning goods in the channels so that the product pusher urges them to one end of the tray for retail purchase.

* * * * *